United States Patent [19]

Karino et al.

[11] Patent Number: 4,546,748

[45] Date of Patent: Oct. 15, 1985

[54] FUEL INJECTION SYSTEM

[75] Inventors: Kimiji Karino; Tokuo Kosuge, both of Katsuta, Japan

[73] Assignee: Hitachi, Ltd., Tokyo, Japan

[21] Appl. No.: 509,393

[22] Filed: Jun. 30, 1983

[30] Foreign Application Priority Data

Jul. 2, 1982 [JP] Japan ..... 57-115969

[51] Int. Cl.[4] ..... F02M 51/00

[52] U.S. Cl. ..... 123/494; 123/492; 123/442; 123/478

[58] Field of Search ..... 123/494, 492, 585, 442, 123/470, 472, 445, 478; 73/118, 116; 261/23 A, 52

[56] References Cited

U.S. PATENT DOCUMENTS

| | | | |
|---|---|---|---|
| 3,721,428 | 3/1973 | Geló et al. | 123/442 |
| 3,747,577 | 7/1973 | Mauch et al. | 123/494 |
| 3,776,208 | 12/1973 | Stumpp | 123/494 |
| 4,303,048 | 12/1981 | Nishio | 123/585 |
| 4,351,304 | 9/1982 | Schweizer | 123/585 |
| 4,389,996 | 6/1983 | Yaegushi et al. | 123/585 |
| 4,404,846 | 9/1983 | Tamauchi et al. | 123/494 |
| 4,416,241 | 11/1983 | Knapp et al. | 123/494 |
| 4,417,558 | 11/1983 | Osuga et al. | 123/494 |
| 4,484,551 | 11/1974 | Choma et al. | 123/442 |

*Primary Examiner*—Raymond A. Nelli

*Attorney, Agent, or Firm*—Antonelli, Terry & Wands

[57] ABSTRACT

A fuel injection system for an internal combustion engine has a fuel injector disposed in a main air passage upstream of a throttle valve. A part of air flowing through the main air passage is caused to flow through a by-pass air passage having outlet ports open to the main air passage upstream of the injection orifice of the injector. A thermal type air flow meter measures the rate of air flow through the by-pass air passage. In order to prevent whirling-up of injected fuel and resultant adhesion of the fuel to walls adjacent to the by-pass air passage outlet ports, the cross-sectional area of the main air passage adjacent to the by-pass air passage outlet ports is determined to be greater than that of the main air passage around the throttle valve when in its fully open position.

19 Claims, 12 Drawing Figures

FUEL INJECTION SYSTEM

BACKGROUND OF THE INVENTION

The present invention relates to a fuel injection system for automotive engines and, more particularly, to a fuel injection system equipped with a thermal type air flow meter.

An electronic fuel control system has been put into practical use in which the rate of fuel supply to an engine is controlled in accordance with a signal representing the intake air flow rate and other signals representing the condition of operation of the engine. This type of electronic fuel control system is taking a growing interest not only from the view point of reduction in fuel consumption but also from the view point of emission control as well.

On the other hand, for a multi-cylinder engine having an injection type fuel supply system, it is considered a better policy from the view point of cost of manufacture to provide only one fuel injector in the gathering portion of the intake manifold or at a point upstream of the throttle valve in the intake system. The known electronic fuel control system usually incorporates a microcomputer which operates to determine the optimum fuel supply rate on the basis of a signal from an air flow meter as well as other signals representing the condition of operation of the engine, e.g., engine speed signal, intake pressure signal, throttle valve opening degree signal, atmospheric pressure signal and so forth. Vane type air flow meters comprising rotatable vanes and air flow meters of Karman's vortex street are now available for use as the air flow meters in the electronic fuel control systems of the kind specified above.

The conventional electronic fuel control system, however, suffers from the following problems arising from the method of metering the intake air flow rate. Namely, since the method conventionally used for metering the air flow rate cannot directly sense the air flow rate in terms of weight, it is not possible to accurately control the air-fuel ratio in response to a change in the atmospheric pressure. In addition, the conventionally used air flow meter has such a large size as to make it difficult to find its mounting space.

It is also to be pointed out that the productivity is inevitably low because the production process has been such that the final confirmation of the performance of the fuel control system as a whole is made after the mounting of the air flow meter and the fuel injection system which are fabricated and administrated separately.

In order to obviate this problems, it has been attempted to use, as proposed in the specification of the U.S. Pat. No. 4,264,961, a hot-wire type sensor having a sensing hot wire disposed in a by-pass air passage formed in a venturi chamber. This attempt, however, encounters the following problem: When the velocity of the intake air flow is increased, the fuel injected by the injector is whirled up around the outlet of the by-pass air passage subjected to the venturi vacuum and is undesirably adhered to the wall of the intake passage to impair the atomization of the fuel. This problem is serious particularly when the engine is operating under a heavy load with a wide throttle opening because, in such a case, the adhesion of the fuel to the intake passage wall is increased due to a heavy whirling of fuel particles caused by the pulsation of the intake vacuum.

SUMMARY OF THE INVENTION

Accordingly, it is a primary object of the invention to provide a fuel injection system which is improved to eliminate any substantial adhesion of fuel to the wall of the intake passage.

In the fuel injection system according to the present invention, the main air passage includes a venturi section to which a by-pass air passage is opened at its downstream end and in which a fuel injector is disposed. A throttle valve is disposed in the main air passage downstream of the venturi section. The main air passage is dimensioned such that the cross-sectional area of the venturi section is greater than the cross-sectional area of the main air passage defined between the throttle valve when in its fully opened position and the inner peripheral surface of the main air passage around the throttle valve.

The invention will be described by way of example with reference to the accompanying drawings.

DESCRIPTION OF THE PREFERRED EMBODIMENT

Figure 1:
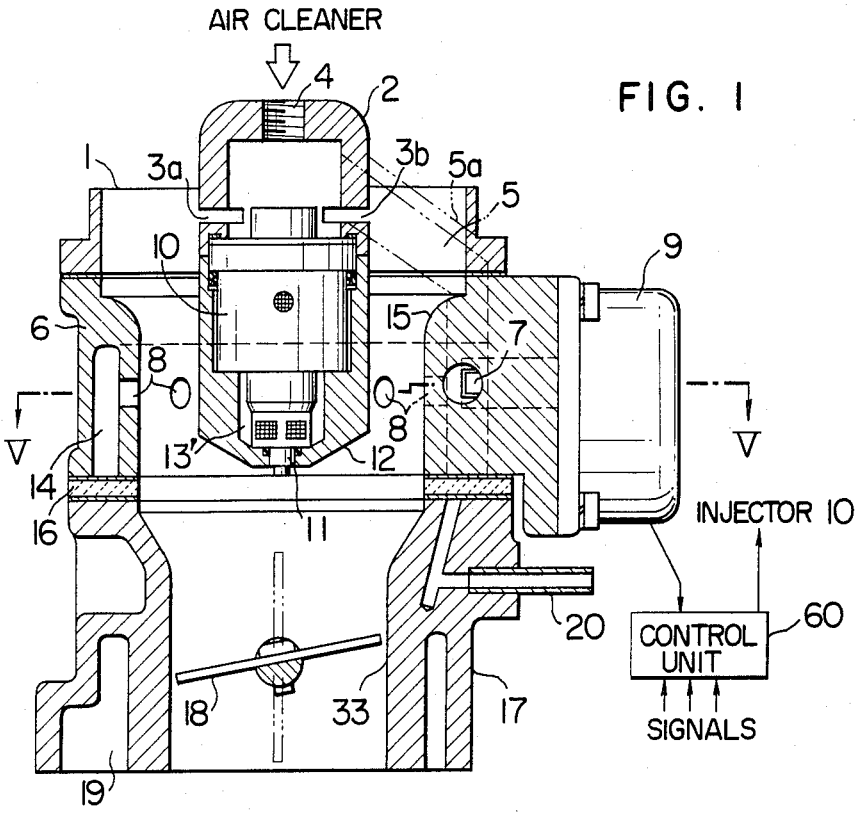
FIG. 1 is a vertical sectional view of an embodiment of a fuel injection system in accordance with the invention.

FIG. 1 shows in a vertical section an embodiment of a fuel injection system in accordance with the invention. An air chamber 1 to be connected with an air cleaner (not shown) is connected to a venturi or injector chamber 6 which in turn is connected through a heat insulating member 16 to the upper end of a throttle chamber 17 accomodating therein a throttle valve 18. A fuel injector 10 is attached to a cap 2 which is positioned in the center of the air chamber 1 and suspended from the center of the air cleaner. The interior of the cap 2 is communicated with an annular passage 14 formed in the wall of the venturi chamber 6, through a by-pass air passage 5 shown by broken lines. The annular passage 14 accomodates therein a hot wire 7 and is opened to the venturi chamber 6 through a plurality of outlet ports 8. A reference numeral 9 designates a thermal type air flow meter for processing a signal from the hot wire 7, while a reference numeral 12 denotes a support for the injector 10.

The fuel injection system having the construction heretofore described operates in a manner explained hereinunder.

When an engine having the fuel injection system is operated, air is sucked through the air cleaner and then through the venturi chamber 6. A part of this air, however, is caused to flow into the annular passage 14 through inlet ports to be discussed later and the by-pass air passage 5 and then flows into the venturi chamber through the air outlet ports 8.

The support 12 which accomodates and supports the injector 10 is placed in the venturi chamber such that an annular air passage is formed between the inner peripheral surface of the venturi chamber and the outer peripheral surface of the support 12. Thus, the whole part of the intake air flows through this annular passage.

The hot wire 7 disposed in the annular air passage 14 senses the flow rate of air flowing through the by-pass air passage 5 and delivers a signal to the thermal type air flow meter 9 which produces a signal representing the total flow rate of the intake air. Needless to say, it is possible to use a hot film in place of the hot wire. A control unit 60 receives the signal from the thermal type air flow meter 9 as well as other signals such as those representing the throttle opening degree, rate of increase of the throttle opening degree, manifold vacuum, engine speed, atmospheric pressure, temperature of ambient air and so forth. The controller 60 then processes these signals to compute and determine the rate and timing of the fuel injection from the injector 10.

The fuel is injected by the injector 10 into the flow of intake air at a rate and a timing determined by the control unit 60 and is atomized into fine particles which are then mixed with the intake air. The mixture is then sucked by the engine through a space between the throttle valve 18 and the wall of the intake pipe around the throttle valve 18.

In a heavy-load operation of the engine, the throttle valve 18 is opened fully as shown by broken lines in FIG. 1 and the intake air flows at a large flow rate over and past the air outlet ports 8 of the by-pass passage 5, so that the pressure around the air outlet ports is lowered considerably. In consequence, the fuel injected from the nozzle orifice in the lower end of the injector 10 tends to be whirled up around the support 12 and the venturi portion and adhered to the wall of the venturi chamber. This tendency is remarkable particularly when the flow velocity of air in the venturi chamber is equal to or higher than the velocity of air flowing past the throttle valve 18. The adhesion of the fuel to the wall of the venturi chamber unfavourably impairs the atomization of the fuel and causes various problems such as speed-down of response of the fuel supply to varying demand.

In order to obviate this problem, according to the invention, the cross-sectional area of the air passage around the throttle valve 18 when in its fully opened position is selected to be smaller than the cross-sectional area of the annular air passage between the venturi chamber and the injector support 12. Therefore, the vacuum established at the downstream side of the throttle valve 18 is maintained at a level higher than that in the venturi chamber. The undesirable whirling-up of the fuel, therefore, is avoided and fine particles of the fuel injected from the fuel injector 10 are allowed to flow around the throttle valve 18 into the engine in good order. As a result, the atomization of the fuel as well as the response of the fuel supply are improved to ensure an improved condition of operation of the engine under heavy load. In consequence, the emission of noxious substances from the engine is reduced and the fuel consumption is decreased advantageously.

It will be apparent to those skilled in the art that, provided that the above-explained condition concerning the cross-sectional areas of air passage is met when the throttle valve 18 is fully opened, the cross-sectional area of the annular air passage in the venturi chamber naturally exceeds the cross-sectional area of the intake air passage around the throttle valve 18 in part-throttle engine operating conditions, so that the fine particles of the injected fuel flow around the throttle valve 18 into the engine without being whirled up around the air outlet ports 8. Thus, according to the invention, the above-described advantages are obtained over the entire range of engine operation.

As has been described, in the fuel injection system of the invention, the cross-sectional area of the annular air flow passage defined between the support 12 for the injector and the wall of the venturi chamber is selected to be greater than the cross-sectional area defined between the intake passage wall and the throttle valve 18 when the latter is opened fully, so that the undesirable whirling-up and adhesion of fuel to the wall of the venturi chamber is avoided to ensure a stable and rapid response of fuel supply into the engine. This in turn offers remarkable advantages such as improvement in the engine drivability and reductions in the fuel consumption and in the noxious emission.

Although, in the described embodiment, the fuel injector 10 is installed at the center of the venturi chamber 6, this is not exclusive and the injector may be mounted at an inclination to the axis of the venturi chamber.

An explanation will be made hereinunder as to the details of various portions of the fuel injection system of the invention.

Figure 2:
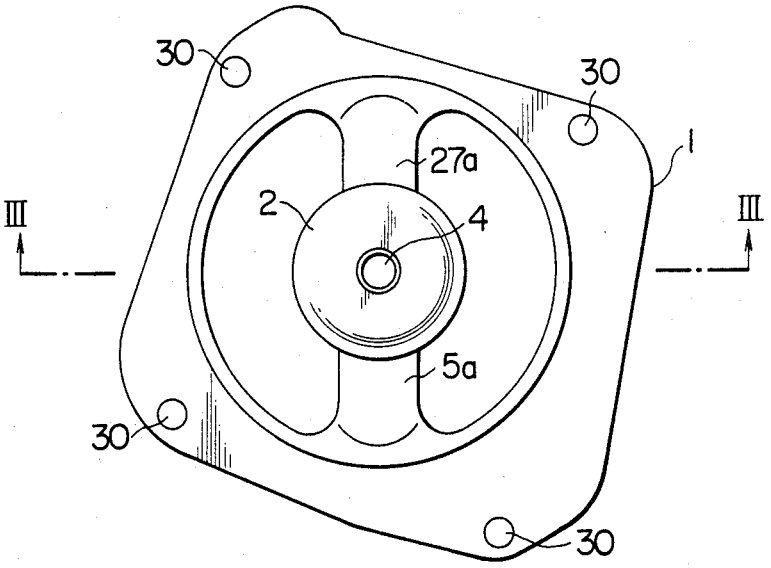
FIG. 2 is a plan view of an air chamber incorporated in the fuel injection system shown in FIG. 1.
Figure 3:
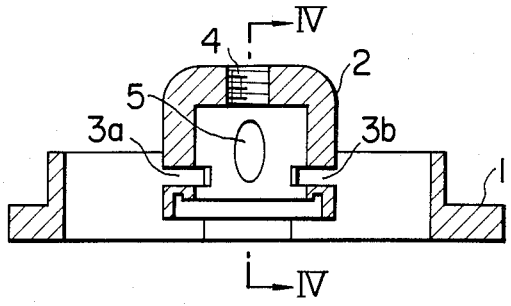
FIG. 3 is a sectional view taken along line III—III in FIG. 2.
Figure 4:
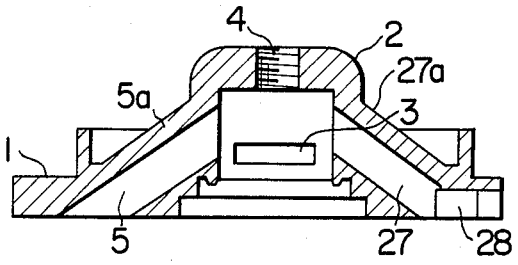
FIG. 4 is a sectional view taken along line IV—IV in FIG. 3.

As will be seen in FIGS. 2 to 4, the air chamber 1 accomodates the cap 2 located at the center thereof. The cap 2 is formed in the side wall thereof with slit-like inlet ports **3*a* and 3*b* leading to the by-pass air passage 5 and in the top wall thereof with a central threaded hole 4** for centering the air cleaner.

FIG. 2 is a plan view of the air chamber 1 shown in FIG. 1, while FIG. 3 is a sectional view taken along line III—III in FIG. 2. FIG. 4 is a sectional view taken along line IV—IV in FIG. 3.

Referring to these drawings, the cap 2 has an arm **5*a* in which the by-pass air passage 5 is formed and an arm 27*a* having a passage 27 for wiring to the fuel injector 10. The cap 2 is supported by these arms 5*a* and 27*a*. As mentioned before, the cap 2 is provided in its side wall with a pair of slit-like inlets 3*a* and 3*b* to the by-pass air passage 5. A gromet for the wiring is attached to a pit 28. The air chamber 1 is designed for an easy production by die-casting and has four bolt holes 30** at respective corners.

Figure 5:
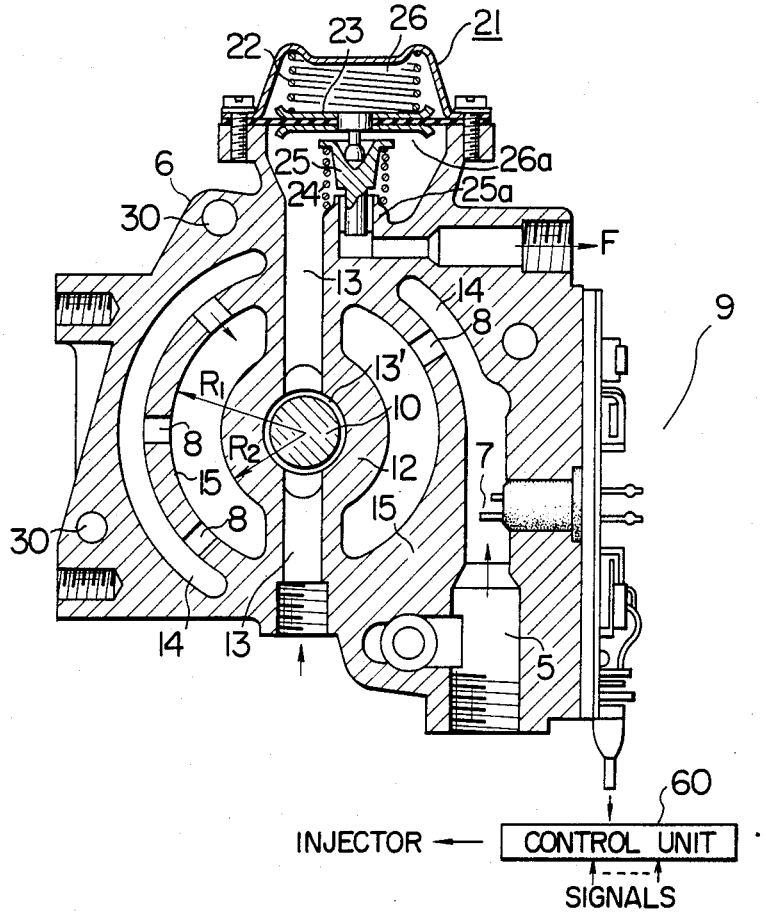
FIG. 5 is a sectional view taken along line V—V in FIG. 1.

Referring now to FIG. 5 which is a cross-sectional view of the venturi chamber 6 taken along line V—V in FIG. 1, the by-pass air passage 5 formed in the arm **5*a* of the cap 2 is connected to a by-pass air passage which is also designated at the same numeral 5 and shown at the right lower part of FIG. 5. The by-pass air passage 5 leads to the annular air passage 14 through a passage in which the hot wire 7** of the thermal type air flow meter is disposed.

The air then flows into the intake passage through the by-pass air outlet ports 8. The aforementioned support 12 constitutes a core of the venturi chamber. The support 12 accomodates the fuel injection valve 10 therein and is supported by arms extending in parallel with the shaft of the throttle valve 18. A radial fuel passage 13 is formed in these arms.

As will be clearly understood from the position of the line V—V in FIG. 1, FIG. 5 shows in section a lower part of the fuel injector 10. The space around the fuel injector 10 constitutes an annular fuel passage 13'. Thus, the fuel injector 10 is of the type having a ball valve which is moved up and down by the pressurized fuel introduced into the passage 13'. The construction of the fuel injector 10 will be described later in more detail with specific reference to FIG. 12.

The fuel supplied to the fuel passage 13' is regulated by a fuel pressure regulating valve 21 to a predetermined pressure and is continuously returned to the fuel tank. The fuel pressure regulating valve 21 has a diaphragm 23 separating an atmospheric pressure chamber 26 and a fuel chamber **26*a*, and a valve 25 engaged with a projection secured to a central portion of the diaphragm 23 and adapted to cooperate with a valve seat 25*a*. A small coil spring 24 is disposed between the valve seat 25*a* and the valve 25 to normally bias the valve 25 away from the valve seat 25*a*. On the other hand, the diaphragm 23 is biased by a spring 22 larger than the spring 24 and disposed in the atmospheric pressure chamber 26. The arrangement is such that, when the fuel pressure is increased beyond a predetermined level, the diaphragm 23 is deflected against the spring 22 so that the valve 25 is moved away from the valve seat 25*a* to lower the fuel pressure in the fuel passage 13'. To the contrary, when the fuel pressure comes down below the predetermined level, the diaphragm 23 is deflected against the small coil spring 24 so that the valve 25 is moved into sealing engagement with the valve seat 25*a* to again increase the fuel pressure in the passage 13'**. In consequence, the fuel pressure is kept substantially constant.

A processor for processing the signal from the hot wire 7 and, hence, constituting the thermal type air flow meter 9 is disposed on the right side of the venturi chamber 6 as viewed in FIG. 5. The venturi chamber 6 is provided with four bolt holes 30 at the corners.

Figure 6:
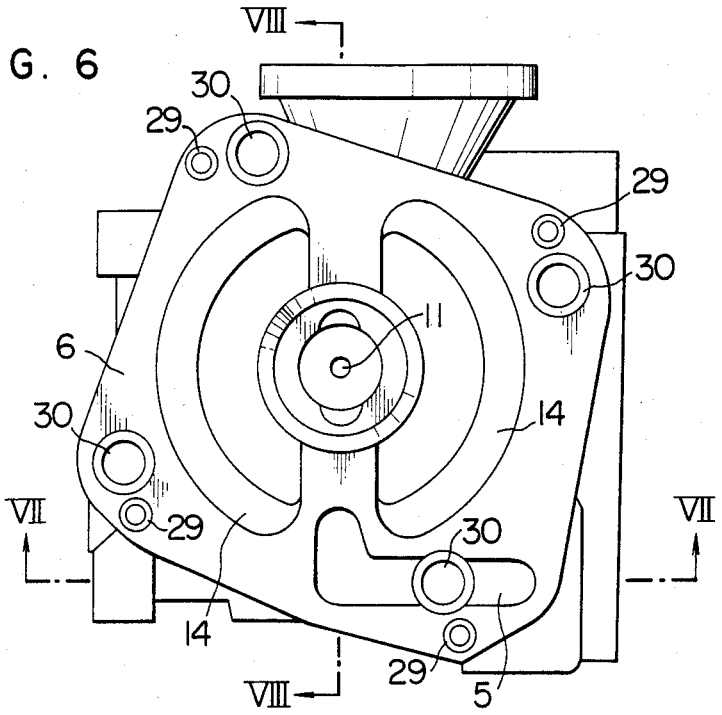
FIG. 6 is a plan view of a venturi chamber.
Figure 7:
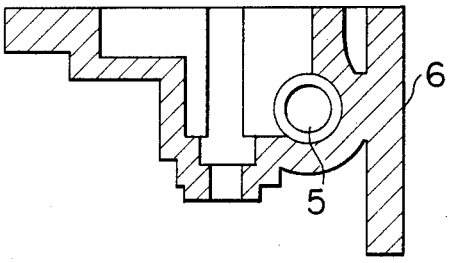
FIG. 7 is a sectional view taken along line VII—VII in FIG. 6.

A reference will be made to FIG. 6 which is a plan view of the venturi chamber, to FIG. 7 which is a sectional view taken along line VII—VII in FIG. 7 and to FIG. 8 which is a sectional view taken along line VIII—VIII of FIG. 6. The venturi chamber 6 is secured to the throttle chamber 17 through the heat insulation plate 16 by means of bolts extending through the bolt holes 30. The venturi chamber 6 is provided in the four corners thereof with holes 29 through which bolts extend to secure the air chamber 1 to the venturi chamber 6. The by-pass air passage 5 shown in FIG. 7 communicates with the annular air passage 14 through the passage in which the hot wire 7 of the sensor 9 is disposed. The outer surface of the right side wall of the venturi chamber 6 is flattened to provide a face on which the thermal type air flow meter 9 is mounted.

Figure 8:
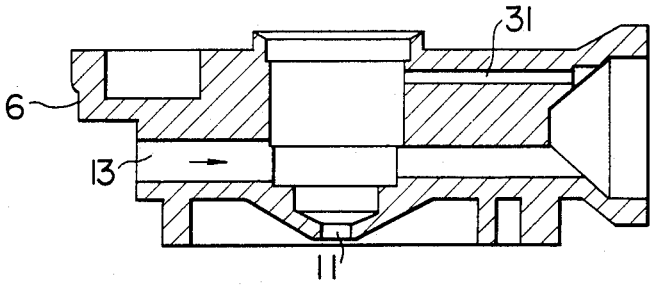
FIG. 8 is a sectional view taken along line VIII—VIII in FIG. 6.

Referring to FIG. 8 which shows the venturi chamber 6 in section taken along the fuel passage 13, the venturi chamber 6 is provided in its upper portion with a fuel vapor relief passage 31. The passages 13 and 31 both lead to the fuel pressure regulating valve 21. The central cavity of the venturi chamber 6 receives the fuel injector 10 which has a bottom end communicated with the fuel passage 13. The venturi chamber 6 is designed for an easy production by die-casting.

Figure 9:
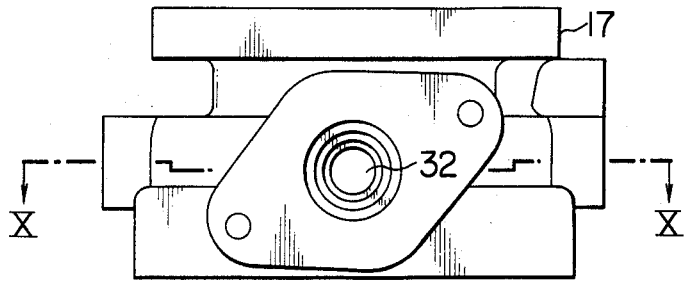
FIG. 9 is a front elevational view of a throttle body.
Figure 10:
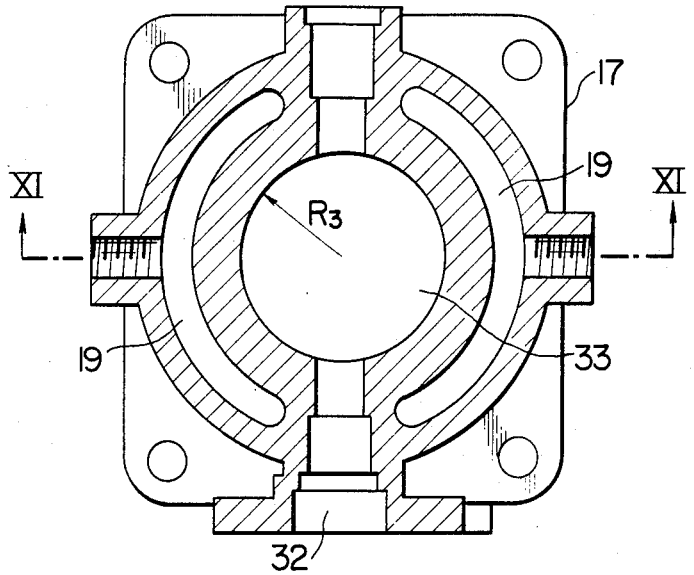
FIG. 10 is a sectional view taken along line X—X in FIG. 9.
Figure 11:
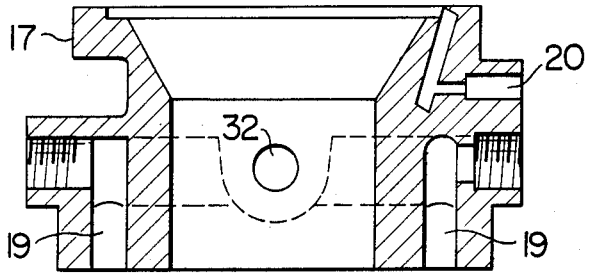
FIG. 11 is a sectional view taken along line XI—XI in FIG. 10.

As will be seen from FIG. 9 which shows the throttle chamber 17 in side elevation, a throttle shaft bore 32 for receiving a shaft of the throttle valve 18 is formed in the throttle chamber 17. FIG. 10 shows the throttle chamber 17 in section taken at a plane including the throttle shaft bore 32. A water jacket 19 is formed in the peripheral wall of the intake passage 33 around the throttle valve 18 so that a warmed engine cooling water or coolant is circulated through the jacket 19. As will be seen in FIG. 11, a vacuum port 20 is formed in the wall of the venturi chamber 17 upstream of the throttle shaft 32. The throttle chamber 17 is also designed for easy production by die-casting.

An explanation will be made hereinunder as to the dimensions of major parts. Referring first to the cross-sectional area of the annular air passage formed in the venturi chamber, the annular passage is divided by the arms containing the fuel passage 13 into two arcuate segments, each being defined by an arc of a radius $R_1$ and an arc of a radius $R_2$, as will be seen in FIG. 5. The radii $R_1$ and $R_2$ are 28 mm and 16 mm, respectively. Thus, each arcuate segment has an area of about 650 $mm^2$. That is, the annular air passage in the venturi chamber has a total cross-sectional area of about 1300 $mm^2$.

On the other hand, the cross-sectional area of the air passage defined between the throttle valve 18 when in its fully-open position and the inner peripheral wall of the intake passage around the throttle valve is decided as follows: As shown in FIG. 10, the intake passage 33 has a circular cross-section and accommodates therein the throttle valve shaft. The radius $R_3$ of the intake air passage 33 is 21 mm, so that the cross-sectional area of the intake air passage 33 is about 965 $mm^2$ when the throttle valve 18 is fully opened. Thus, the cross-sectional area of the annular air passage in the venturi chamber is about 35% greater than that of the intake air passage around the throttle valve 18 when the latter is opened fully.

Figure 12:
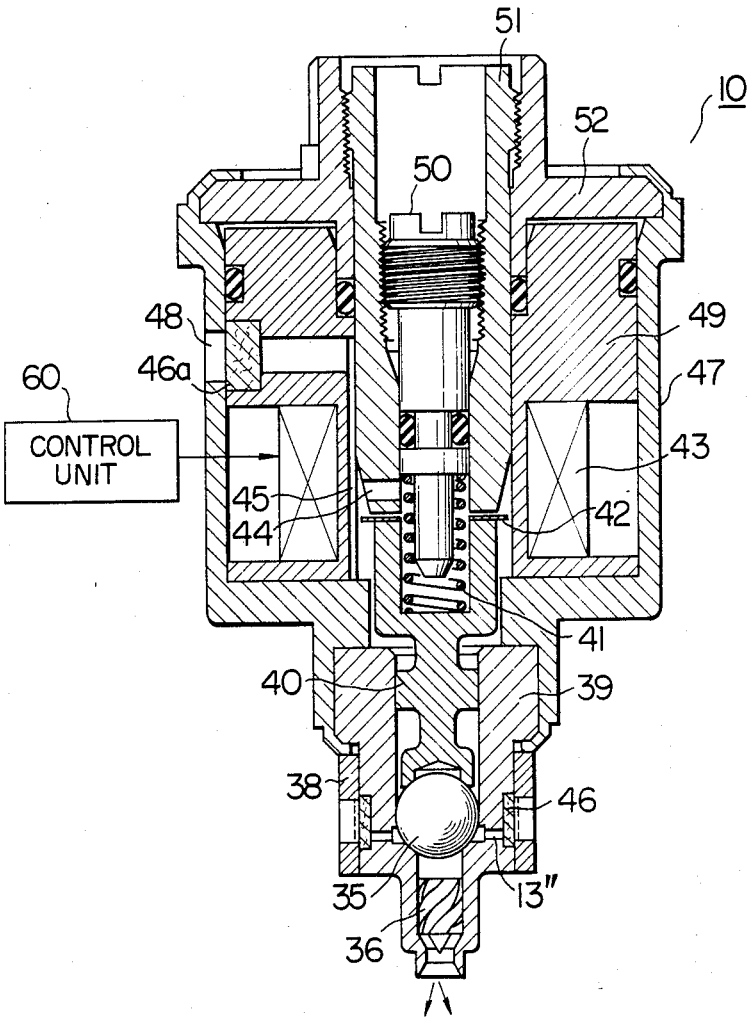
FIG. 12 is a vertical sectional view of a fuel injector incorporated in the fuel injection system shown in FIG. 1.

Referring finally to FIG. 12 which is an enlarged axial sectional view of the fuel injector 10 shown in FIG. 1, the fuel injector 10 has a plunger 40 with a ball valve 35 attached to the lower end thereof. The plunger 40 is adapted to be moved up and down within a tubular nozzle 39. The pressurized fuel supplied through the fuel passage 13 is injected when the ball valve 35 is raised. At this time, the injected fuel is swirled and diffused as it flows through spiral grooves in a swirler 36 disposed at the outlet of the nozzle 39. The nozzle 39 is provided with radial fuel passages 13" leading to the ball valve 35. The fuel passages 13" are covered by a filter 46 fitted in an annular recess in the peripheral surface of the nozzle 39 and fixed by means of a ring 38 screwed to the nozzle 39. The upper end of the plunger 40 opposes the lower end of a sleeve 51 through an annular partition plate 42 disposed therebetween. The plunger 40 is provided with a central recess formed in the upper surface thereof and receiving a spring 41 which is pressed by an adjusting screw 50 screwed into a threaded bore formed in the sleeve 51. The load of the spring 41 is freely adjustable by screwing and unscrewing the adjusting screw 50. The sleeve 51 is provided with a transverse hole 44 so that a part of the fuel displaced by the up and downward movement of the plunger 40 flows into and out of the transverse hole 44.

The fuel flows through a gap 45 between a bobbin 49 and the sleeve 51 and is relieved through a small port 48 covered by a filter 46*a*. This fuel then returns to the fuel passage 13 along the inner surface of the support 12. Namely, a part of the fuel flows through the fuel injector 10 to effectively serve as a coolant for carrying heat away from a coil 43 thereby to suppress the undesirable temperature rise. An end plate 52 forms a part of a magnetic path for strengthening the effect of the coil 43.

The one-point injection type fuel injection system of the invention, comprising the injector 10 disposed at the upstream side of the throttle valve 18, has its component parts, such as the air chamber 1, venturi chamber 6 and the throttle chamber 17, all of which are designed for easy production by die-casting. The fuel injection system, in addition, offers the following advantages:

(1) The mounting of the fuel injector 10 can be made in quite a rational and superior manner. Namely, the fuel injector 10 is reliably and easily accommodated by an enclosure formed by the cap 2 disposed in the center of the air chamber 1 and the support 12 disposed in the center of the venturi chamber 6. In addition, the inlet ports 3*a* and 3*b* of the by-pass air passage 5 are formed in the peripheral wall of the cap 2 to minimize the influence of the blowing back of the intake air. The by-pass air passage 5 and the passage 27 for wiring to the fuel injector 10 are conveniently formed in the arms 5*a* and 27*a*, respectively, by which the cap 2 is mounted.

(2) A rational construction of the by-pass air passage is realized. Hitherto, it has been a usual measure to form the by-pass air inlet ports 3*a* and 3*b* in the peripheral wall of the intake passage above the venturi. In the fuel injection system of the invention, however, the inlet ports 3*a* and 3*b* to the by-pass air passage 5 are formed in the peripheral wall of the cap 2 and communicated with the by-pass air passage 5 in the wall of the venturi chamber 6 through the passage 5 formed in the arm 5*a*. In consequence, the dust and other matters suspended by the intake air are kept away from the by-pass air passage in which the hot wire 7 is disposed, whereby the hot wire 7 is free from any adverse effect which may be produced by the blowing back of the air. In addition, since the air from the by-pass air passage 5 is discharged into the venturi chamber through a plurality of ports 8, it is possible to make the flow of air uniform by eliminating any interference of intake vacuum which may be caused by the arms 5*a* and 27*a* in the air chamber 1 for mounting the support 12 therein.

(3) Evaporation of fuel is promoted in the throttle chamber 17. Namely, if the fuel is adhered to the wall of the throttle chamber 17 around the throttle valve 18, the adhered fuel is evaporated by the heat derived from the warmed cooling water circulated through the water jacket 19 formed in the wall of the throttle chamber 17. This in turn contributes to an improvement in the response of the fuel supply.

(4) The overall size of the fuel injection system can be reduced owing to the concentration of the parts such as the fuel pressure regulating valve and the air flow meter into a small area. Namely, the fuel pressure regulating valve 21 and the thermal type air flow meter 9 are disposed in a well ordered arrangement and are both secured to the venturi chamber 6, so that it is not necessary to preserve mounting spaces separately for the fuel pressure regulating valve 21 and the air flow meter 9.

As has been described, the invention provides, a fuel injection system which is improved to eliminate adhesion of fuel to the wall of the venturi chamber to ensure a good response of the fuel supply to the engine, which in turn offers improvements in the engine drivability, in the fuel consumption and in the emission control over the entire range of the engine operation.

What is claimed is:

1. A fuel injection system for an internal combustion engine comprising:

means defining an intake passage;

a throttle valve disposed in said intake passage and adapted to control the flow rate of air to be sucked into the engine;

a fuel injector disposed in said intake passage upstream of said throttle valve and adapted to supply fuel into said engine;

means in said intake passage for supporting said fuel injector therein;

said injector supporting means having an outer peripheral survace spaced inwardly from the inner peripheral surface of said intake passage defining means to cooperate therewith to define a generally annular intake passage section having a minimum unobstructed cross-sectional area which is greater than the maximum cross-sectional area of an intake passage section defined between said throttle valve when in a fully open position and the inner peripheral surface of said intake passage defining means surrounding said throttle valve whereby undesirable whirling-up of fuel about said supporting means is avoided.

2. A fuel injection system according to claim 1, wherein said intake passage defining means include an injector chamber accommodating said injector supporting means and a throttle chamber accommodating said throttle valve, said injector chamber and said throttle chamber being secured together by fastening means.

3. A fuel injection system according to claim 2, wherein said injector chamber defines therein a part of said intake passage, said throttle chamber defines therein another part of said intake passage, said parts of said intake passage being connected by a transition section of a cross-sectional area which decreases gradually to the intake passage part defined in said throttle chamber.

4. A fuel injection system according to claim 3, wherein said transition section is defined in said throttle chamber.

5. A fuel injection system according to claim 2, wherein said injector supporting means is integral with said injector chamber.

6. A fuel injection system according to claim 5, wherein said injector supporting means has at least two arms connected to said injector chamber.

7. A fuel injection system according to claim 6, further including a cap covering said injector supported by said injector supporting means.

8. A fuel injection system according to claim 7, further including an air chamber connected to said injector chamber at the end thereof remote from said throttle chamber, said air chamber being integral with said cap.

9. A fuel injection system according to claim 8, wherein said cap has at least two arms connected to said air chamber.

10. A fuel injection system according to claim 9, wherein two arms of said injector supporting means and two arms of said cap are respectively substantially aligned as viewed in the direction of the flow of air through said intake passage.

11. A fuel injection system according to claim 6, wherein at least one of the arms of said injector supporting means is formed therein with a passage for the fuel to be fed to said injector.

12. A fuel injection system according to claim 11, wherein another one of the arms of said injector supporting means is formed therein with another passage for the fuel to be returned to a fuel source.

13. A fuel injection system according to claim 6, wherein said throttle valve is rotatably supported by a throttle shaft extending transversely through said intake passage and wherein two arms of said injector supporting means are substantially aligned with said throttle shaft as viewed in the direction of the flow or air through said intake passage.

14. A fuel injection system according to claim 6, wherein said throttle chamber has a peripheral wall in which a passage is formed for the flow of an engine cooling liquid.

15. A fuel injection system according to claim 14, wherein said engine cooling liquid passage is formed along at least a part of the periphery of said throttle chamber.

16. A fuel injection system according to claim 1, further including means defining a bypass air passage bypassing a part of said generally annular intake passage section and having at least one outlet port open to said annular intake passage section, and a heat-sensitive resistor disposed in said bypass air passage and adapted to measure the rate of the air flow through said bypass air passage.

17. A fuel injection system according to claim 16, wherein said bypass air passage includes a generally annular bypass air passage section formed in the peripheral wall of said intake passage defining means.

18. A fuel injection system according to claim 17, wherein said bypass air passage has a plurality of outlet ports open to said annular intake passage section.

19. A fuel injection system according to claim 16, further including a cap cooperating with said injector supporting means to enclose said injector, each of said injector supporting means and said cap having at least two arms connected to said intake pasage defining means, at least one of the arms of said cap being formed therein with a part of said bypass air passage, said cap having an outer peripheral surface formed therein with an air inlet leading to said bypass air passage.

* * * * *